US006173497B1

(12) United States Patent
Domenge

(10) Patent No.: US 6,173,497 B1
(45) Date of Patent: Jan. 16, 2001

(54) NAIL CLIPPERS

(76) Inventor: Alberto G. Domenge, Fuente de Las Aguilas 194, Tecamachalco 53950 Edo. de Mex. (MX)

( * ) Notice: Under 35 U.S.C. 154(b), the term of this patent shall be extended for 0 days.

(21) Appl. No.: 09/025,649

(22) Filed: Feb. 18, 1998

(51) Int. Cl.[7] ..... A45D 29/02; B26B 17/02

(52) U.S. Cl. ..... 30/28; 30/124; 132/75.5

(58) Field of Search ..... 30/28, 124, 191, 30/26, 27, 29, 189, 187; 132/73.5, 75.5; D28/60

(56) References Cited

U.S. PATENT DOCUMENTS

| | | | | |
|---|---|---|---|---|
| 767,423 | * | 8/1904 | Nicholls | 30/28 X |
| 796,389 | * | 8/1905 | Wright | 30/28 X |
| 806,037 | * | 11/1905 | Wilcox | 30/28 |
| 994,119 | * | 6/1911 | Browning | 30/28 X |
| 1,499,673 | | 7/1924 | Lobl . | |
| 1,721,415 | * | 7/1929 | Schnefel | 30/28 |
| 2,890,706 | | 6/1959 | Guardino | 132/75.5 |
| 3,315,354 | * | 4/1967 | Oates, Jr. | 30/28 |
| 4,117,591 | | 10/1978 | Terry | 30/124 |
| 4,176,449 | * | 12/1979 | Lee et al. | 30/28 |
| 4,196,514 | * | 4/1980 | Merriman | 30/28 |
| 4,648,415 | | 3/1987 | Yuan | 132/73 |
| 4,776,090 | | 10/1988 | Grassi | 30/28 |
| 4,809,431 | * | 3/1989 | Idema | 30/28 |
| 5,052,416 | * | 10/1991 | Rommerdale | 30/28 X |
| 5,063,666 | | 11/1991 | Tsay | 30/28 |
| 5,074,041 | * | 12/1991 | Wagner | 30/28 |
| 5,488,772 | * | 2/1996 | Dababneh et al. | 30/28 |
| 5,522,136 | * | 6/1996 | Larisey | 30/28 |
| 5,806,186 | * | 9/1998 | Langman et al. | 30/28 |

FOREIGN PATENT DOCUMENTS

| | | | | |
|---|---|---|---|---|
| 51800 | * | 10/1889 | (DE) | 30/28 |
| 498725 | | 1/1920 | (FR) . | |
| 2603467 | | 3/1988 | (FR) . | |

* cited by examiner

*Primary Examiner*—Kenneth E. Peterson
(74) *Attorney, Agent, or Firm*—Greenblum & Bernstein, P.L.C.

(57) ABSTRACT

An improved nail clipper having a central symmetrical resilient pincer member with cutting edges at its opened end, a transverse pin with hooked ends that pass through opposed and aligned bores on the jaws of the pincer member near its open end, and lateral handles that are connected at the hooked ends of the transverse pin.

21 Claims, 6 Drawing Sheets

Fig. 20
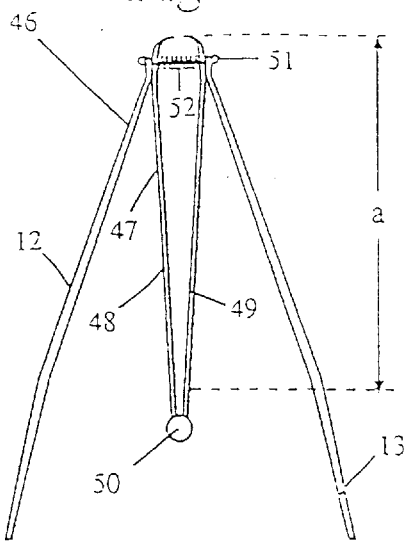
Fig. 21
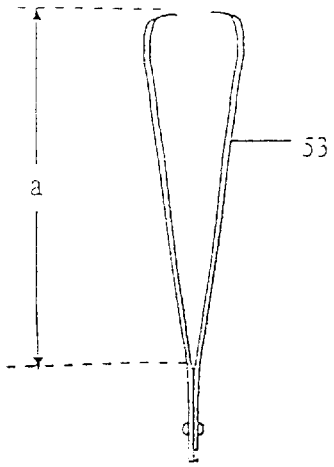
Fig. 22
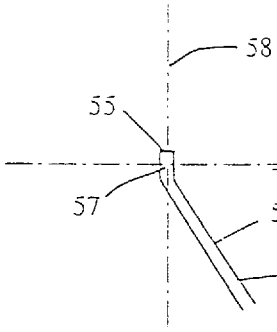
Fig. 23
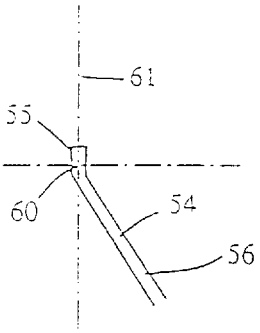
Fig. 24 Fig. 25
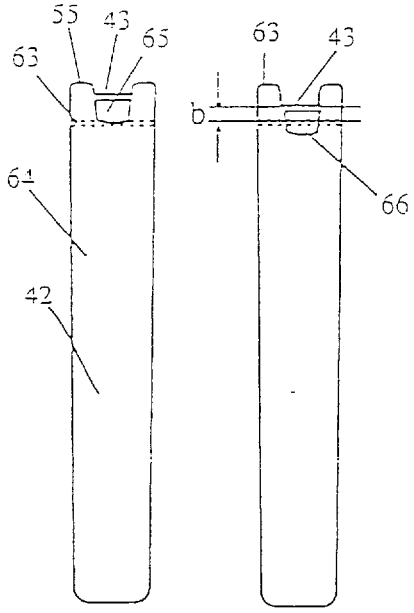
Fig. 27
Fig. 26 A
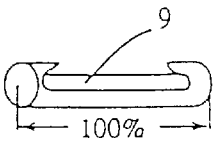
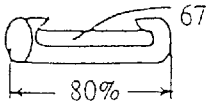
Fig. 26 B
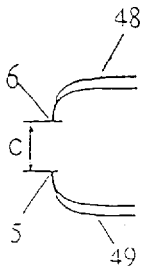

NAIL CLIPPERS

BACKGROUND INFORMATION

1. Field of the Invention

This invention relates to an improved nail clipper and to an improved nail trimming retention device.

2. Discussion of Background Information

Conventional nail clippers of the prior art have a single lateral lever or handle that pivots about a fulcrum during operation, connected with a pair of cutting-edge equipped spring arms designed for finger-tip pressure operation. The lateral lever or handle may be equipped with a protrusion or "toe" that presses against the spring arm to drive the cutting edges into contact during operation. The lateral lever and the handle are in alignment during the cutting stroke. This may impede the comfort or convenience of the user. Further, the use of a single pivoting lateral lever may require excessive movement of the handle to perform the cutting operation.

French Patent 2 603 467 discloses an improved nail clipper utilizing two lateral levers. However, the cutting jaws cannot be rotated relative to the lateral levers because an external casing would prevent such rotation. Again, the requirement that the lateral levers and the cutting jaws be in alignment during operation may impede the comfort or convenience of the user.

U.S. Pat. No. 5,063,666 describes a nail clipper with two lateral handles, and a jaw pincer member formed by a short upper body and a long lower body, which also serves as one of the lateral handles. The jaw pincer member has cutting edges that are parallel, rather than perpendicular, to the longitudinal direction of the handle. Nevertheless, the angle between the cutting edges and the handles cannot be changed during operation, as the open end portion of the jaw pincer member remains fixed perpendicular to the nail clipper handles.

U.S. Pat. No. 2,890,706 discloses a combination manicuring device having two sets of lateral blades. The shorter blades are used as cuticle cutters and the curved longer blades are used as nail cutters. The blades, as well as the file implements and tips, are all unitary with the leaves, and the leaves are secured at one end by spot welds. The secured end also serves as a handle, as is generally the case with prior art nail clippers. Here again, however, independent movement of the jaw pincers, relative to the lateral handles or levers, is not accomplished.

U.S. Pat. No. 4,117,591 discloses an improved nail clipping implement featuring a nail retaining clamping device to secure a nail trimming in position for the duration of a cutting operation. Thin internal blades made of a resilient material are used for achieving the nail retaining function. This solution is not totally reliable, and it is expensive and complicated, requiring substantial manufacturing precision of the thin blades. Moreover, this nail clipping implement also does not permit the nail clipper handle to be moved independently of the jaw pincers during operation.

Accordingly, an object of this invention is to provide an improved nail clipper which permits both lateral handles of the nail clipper handle to be moved independently of the jaw pincers during operation. Further, an object of this invention is to provide a more practical, less expensive and more reliable method of entrapping nail fragments in conjunction with such a nail clipper.

SUMMARY OF THE INVENTION

The improved nail clipper of this invention include two elongated, biased apart jaw members made of spring steel that form a substantially Y-shaped, resilient central pincer member. The jaw members are spot welded and/or riveted together, and are provided with opposed, turned-up and down, cutting edges or blades, having the requisite curvature and clipping ability.

Alternatively, the central pincer member may be a one-piece, resilient, substantially U-shaped member, and also be provided with opposed, turned-up and down, cutting edges or blades, having the requisite curvature and clipping ability.

According to another aspect of the invention, the central jaw member also is substantially U-shaped, and includes two substantially rigid, separate jaw members that are hingedly connected to each other. The jaw members are provided with opposed cutting edges, and are biased apart with a coil spring positioned around the transverse assembling pin.

The first and second jaws members of the nail clippers of the present invention are each provided with aligned, substantially circular bores at their open end portions near the cutting edges. A transverse assembling pin, with a machined central recess (i.e., an under cut portion) and hooked ends, passes through, and can rotate in, these bores. A pair of symmetrical levers or handles provided with a substantially U-shaped notch at their front ends, where they have a cross bar that is hingedly coupled to the hooked ends of the transverse assembling pin.

The lateral levers or handles of the present invention do not generally require the cam-like projection or "toe" with which the handles of prior art nail clippers are provided. The removal of this toe facilitates a more comfortable grip of the nail clipper, as it reduces the angle between the lateral levers and the jaw pincer member, when the handles are positioned at a ready position at the beginning of a cutting stroke. The length of the small tip or notch of the lateral handles or levers may be reduced in order to increase the mechanical advantage of the handles. This reduction of the small tip's length is possible because the cutting edges of the nail clipper of this invention, during a cutting stroke, need to travel a shorter distance than the cutting edges of nail clippers of the prior art, such as half as far, because both jaws of the nail clippers are movable.

According to another aspect of the invention, a coil spring is inserted on the transverse assembling pin, with which it is substantially coaxial, in order to compensate for the lack of resiliency of the jaw members. The coil spring pushes apart the substantially rigid jaw members.

According to the present invention, the lateral handles may be of standard shape or may be provided with ergonomically advantageous features, such as a tear-drop shaped. The lateral handles always remain aligned with each other, independently of their angle of rotation with respect the jaw pincer member. As the lateral handles are pressed toward each other, the cutting edges of the jaw pincer member are urged toward each other, until their cutting edges make contact and a nail inserted therebetween is clipped. The lateral levers can be rotated about the axis of the transverse assembling pin, and they can be positioned and deployed at the ready position where they form an acute angle with respect to the jaw pincer member, or at a closed position, ready for storage. At this latter position, the nail clipper occupies less space. It is understood that the jaw pincer member can be rotated about the axis of the transverse clip and operated at any angle with respect to the lateral levers, which in all instances remain aligned with each other, including during the cutting stroke.

According to one embodiment of the present invention, the nail clipper is provided with high mechanical advantage and is especially designed for clipping toe nails.

This invention also provides alternative devices for catching and holding nail clippings. Further, these devices for entrapping clipped nail fragments preferably use an elastic material (e.g., a plastic material) that is positioned at the end portion of the jaw members, such that when the jaw members come into contact at the end of a cutting stroke, the just-clipped nail fragment is immobilized and remains entrapped as long as the lateral levers are pressed toward each other.

The present invention provides a nail clipper that includes two elongated jaw members having opposed, spaced apart cutting blades at a first end, where the two jaw members are connected at a second end to form a substantially Y-shaped, resilient central pincer member, where the two jaw members having aligned openings; a transverse assembling pin with hooked first and second ends; and two symmetrical elongated handles, where each of the elongated handles has a short portion and a long portion, where the short portion has a U-shaped bifurcated end and a cross bar connecting the bifurcated end, and where each hooked end of the transverse assembling pin is connected with a hinge to a respective handle cross bar to retain the elongated handles in alignment. Further, the long portions of the two symmetrical handles may substantially straight, or they may be curved. A rivet may connect the two jaw members at the second ends. Moreover, the nail clipper may include a tong of an elastic material being provided on an inner portion of the first end of each jaw member, and the tong is capable of blocking and retaining a nail fragment at the end of a cutting stroke. The elastic material of the tong may be a plastic foam, or alternatively it may be rubber.

According to another aspect of the invention, a nail clipper is provided that includes a substantially ellipsoidal piece of an elastic material that has two flat pole ends and a cylindrical axial bore, where the ellipsoidal piece is adapted to receive the transverse assembling pin, where the flat pole ends being in contact with the jaw members, and where the ellipsoidal piece is capable of blocking and retaining a nail fragment at the end of a cutting stroke. The elastic material of the ellipsoidal piece may be a plastic foam.

According to yet another aspect of the invention, a nail clipper is provided that includes two elongated jaw members having opposed cutting blades at a first end, where the two jaw members are connected with a hinge at a second end to form a substantially U-shaped, resilient central pincer member, and where the two jaw members having substantially round, aligned openings; a transverse assembling pin with hooked first and second ends; a coil spring adapted to receive the transverse assembling pin and to bias apart the first ends of the two elongated jaw members; two symmetrical elongated handles, each of the elongated handles including a short portion and a long portion, where the short portion has a U-shaped bifurcated end and a cross bar connecting the bifurcated end, and where each hooked end of the transverse assembling pin being hingedly connected to a handle cross bar to retain the elongated handles in alignment. The effective length of the jaw members may be at least approximately 7.5 cm, and the distance between the cutting blades may be approximately 2.4 mm when the nail clipper is in an open position. Moreover, the long portions of the two symmetrical handles may be substantially straight, or alternatively, the long portions of the two symmetrical handles may be curved.

According to still another aspect of the invention, a nail clipper is provided that includes two elongated jaw members having opposed, spaced apart cutting blades at a first end, where the two jaw members are connected at a second end to form a substantially U-shaped, resilient central pincer member, and where the two jaw members have substantially round, aligned openings; a transverse assembling pin with hooked first and second ends; two symmetrical elongated handles, each of the elongated handles including a short portion and a long portion, where the short portion has a U-shaped bifurcated end and a cross bar connecting the bifurcated end, and where each hooked end of the transverse assembling pin is hingedly connected to a handle cross bar to retain the elongated handles in alignment. The long portions of the two symmetrical handles may be substantially straight, or alternatively they may be curved. Further, the nail clipper may have a tong of an elastic material on an inner portion of the first end of each jaw member, such that tong is capable of blocking and retaining a nail fragment at the end of a cutting stroke. This elastic material of the tong may be a plastic foam, or it may be a rubber. Moreover, the nail clipper may include a substantially ellipsoidal piece of an elastic material having two flat pole ends and a cylindrical axial bore, where the ellipsoidal piece being adapted to receive the transverse assembling pin, where the flat pole ends is in contact with the jaw members, and where the ellipsoidal piece is capable of blocking and retaining a nail fragment at the end of a cutting stroke. Further, the elastic material of the ellipsoidal piece may be a plastic foam.

The aforementioned and following characteristic features can be used not only in the described combinations, but also in other combinations or alone, without leaving the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the drawings, and wherein:

FIG. 20 is a longitudinal side elevation view of a toe nail clipper according to one aspect of the present invention in the open position, ready for use;

FIG. 21 is a longitudinal side elevation view of the pincer jaw member of a toe nail clipper of the prior art;

FIG. 22 is a longitudinal side elevation view of a handle of a toe nail clipper;

FIG. 23 is a longitudinal side elevation view of a handle of a toe nail clipper according to the present invention;

FIG. 24 is a top elevation view of a handle of a toe nail clipper;

FIG. 25 is a top elevation view of a handle of a toe nail clipper according to the present invention;

FIGS. 26A and 26B show enlarged perspective views of jaw pincer members according to further aspects of the present invention;

FIG. 27 is a longitudinal side elevation view of a jaw pincer member according to the present invention at the beginning of a cutting stroke;

DETAILED DESCRIPTION OF THE INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention.

Figure 1:
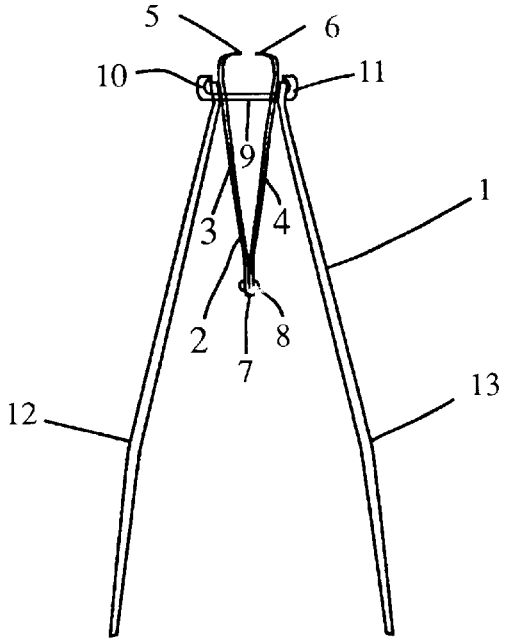
FIG. 1 is a longitudinal side elevation view of one embodiment of the present invention in the open position, ready for use.

According to one embodiment of the present invention, FIG. 1 illustrates nail clipper 1 provided with jaw pincers member 2 having symmetrical first and second members jaws 3, 4 with opposing sharp cutting edges 5, 6. Jaw members 3, 4 are superimposed and rigidly connected at their tails 7 by means of a rivet 8, and/or by spot welding. Transverse assembling pin 9, which is illustrated in more detail in FIGS. 6 and 7, has hooked ends 10, 11, to which substantially straight lateral levers or handles 12, 13, respectively, are coupled. After coupling with transverse assembling pin 9, a fulcrum point is formed between each of the handles and jaw pincer member 2. Jaw members 3, 4, of jaw pincer member 2 are resilient and biased apart.

Jaw members 3, 4, of jaw pincer member 2 each have a substantially round opening, forming a pair of opposed and aligned bores, through which the transverse assembling pin 9 passes and can rotate. Hence, jaw pincer member 2 can rotate relative to lateral handles 12, 13, while lateral handles remain aligned with each other. This feature provides that lateral handles 12, 13, may be pressed into one another to perform a cutting stroke regardless of the rotational angle between the handles and jaw pincer member 2.

Figure 2:
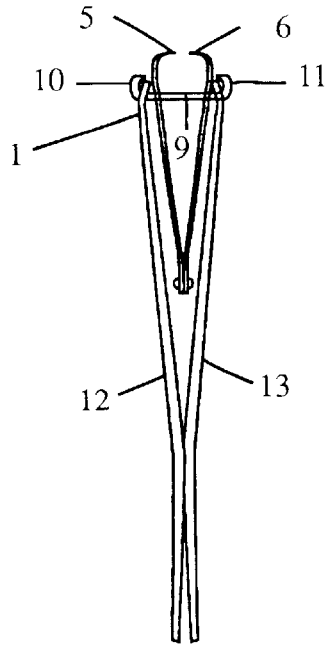
FIG. 2 is a longitudinal side elevation view of the nail clipper of FIG. 1 in its closed position, ready for storage.

FIG. 2 illustrates the embodiment of FIG. 1 where lateral levers 12, 13, are rotated to the closed position, ready for storage.

Figure 3:
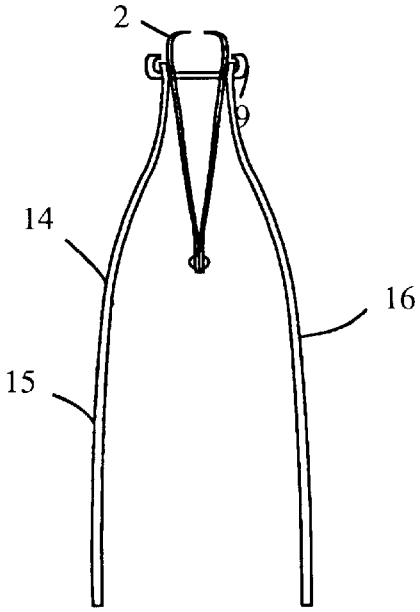
FIG. 3 is a longitudinal side elevation view of another embodiment of the present invention in the open position, ready for use.
Figure 4:
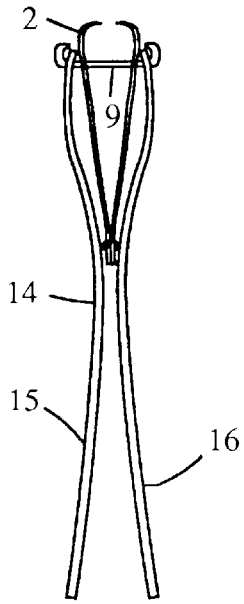
FIG. 4 is a longitudinal side elevation view of the nail clipper of FIG. 3 in its closed position, ready for storage.

FIGS. 3 and 4 illustrate nail clipper 14 in which the handles of FIGS. 1 and 2 have been replaced with curved handles 15, 16. The nail clipper of FIG. 3 is depicted in the open position, ready to use. FIG. 4 illustrates this nail in the closed position, ready for storage.

Figure 5:
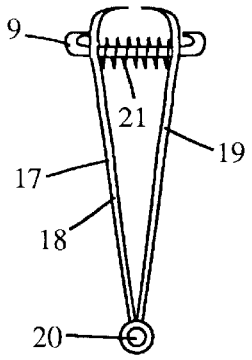
FIG. 5 is a longitudinal side elevation view of the jaw pincer member of another embodiment of the present invention.

FIG. 5 shows jaw pincer member 17 with first member 18 and second jaw member 19 biased apart by coil spring 21. First jaw member 18 and second jaw member 19 are connected at their lower ends by hinge 20, and coil spring 21 is provided and transverse assembling pin 9.

Figure 6:
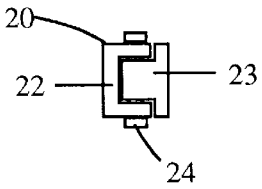
FIG. 6 is an enlarged detailed view of the hinge of the pincer member of FIG. 5.

FIG. 6 illustrates hinge 20 in detail, where hinge 20 includes leaves 22, 23 and pin 24.

Figure 7:
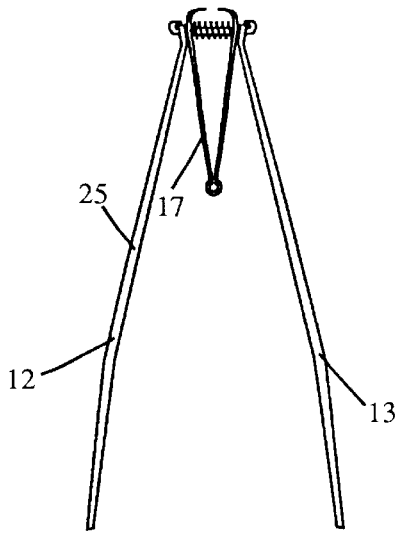
FIG. 7 is a longitudinal side elevation view of yet another embodiment of the present invention in the open position, ready for use.

FIG. 7 illustrates nail clipper 25 provided with jaw pincer member 17, and substantially straight lateral handles 12, 13, shown in the open position, ready for use.

Figure 8:
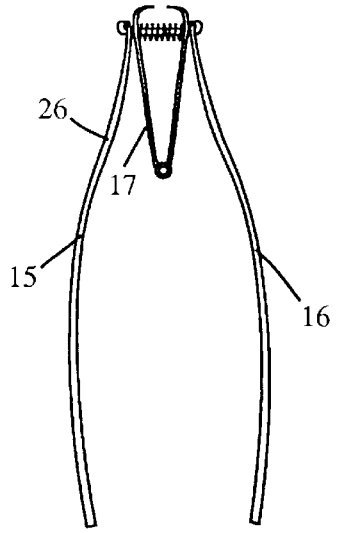
FIG. 8 is a longitudinal side elevation view of yet another embodiment of the present invention in the open position, ready for use.

FIG. 8 illustrates nail clipper 26, provided with jaw pincer member 17, and curved handles 15, 16, shown in the open position, ready for use.

Figure 9:
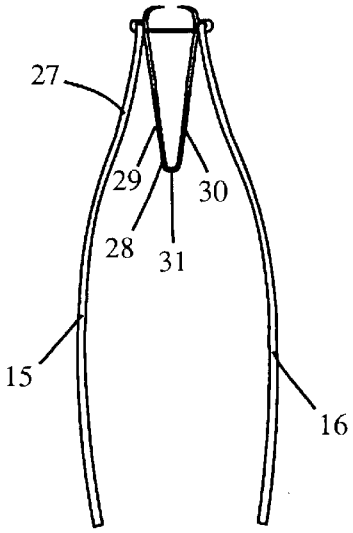
FIG. 9 is a longitudinal side elevation view of yet another embodiment of the present invention in the open position, ready for use.

FIG. 9 shows nail clipper 27 provided with jaw pincer member 28, which is characterized by its single piece construction. Its jaw members 29,30 are united at bottom part 31 and are formed biased apart. Nail clipper 27 is shown with curved lateral handles 15, 16, in the open position, ready for use.

Figure 10:
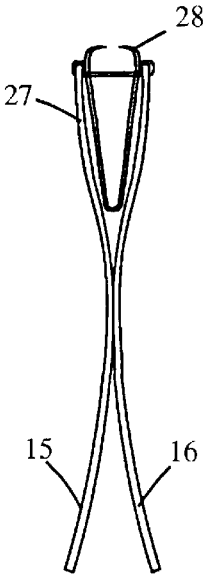
FIG. 10 is a longitudinal side elevation view of the nail clipper of FIG. 9 in its closed position, ready for storage.

FIG. 10 illustrates the nail clipper of FIG. 9 in which the lateral handles are rotated to the closed position, ready for storage.

Figure 11:
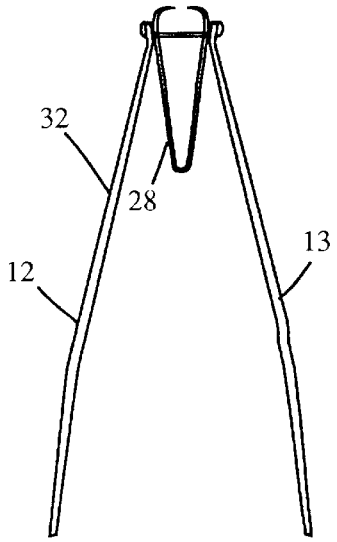
FIG. 11 is a longitudinal side elevation view of yet another embodiment of the present invention in the open position, ready for use.

FIG. 11 illustrates the nail clipper of FIG. 9 with substantially straight lateral handles 12, 13, in the open position, ready for use.

Figure 12:
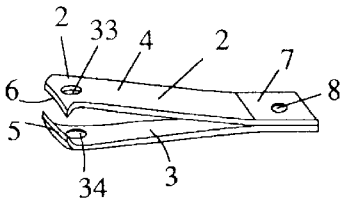
FIG. 12 is a frontal perspective view of the jaw pincer member of one embodiment of the present invention.

FIG. 12 shows a frontal perspective view of the jaw pincer member 2, showing first jaw member 3 and second jaw member 4, having aligned, substantially circular, bores 33,34, near cutting edges 5, 6. The length of tail 7 with rivet 8 is designed to be as possible, because in contrast with prior art nail clippers, jaw pincer member 2 does not serve as a handle for the user.

Figure 13:
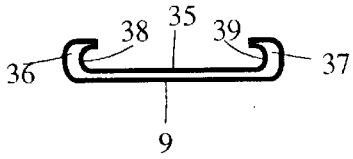
FIG. 13 is an enlarged side elevation view of the assembling pin of FIG. 5.
Figure 14:
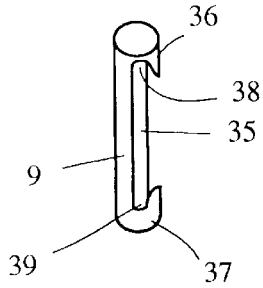
FIG. 14 is an enlarged perspective view of assembling pin of FIG. 13.

FIG. 13 is an enlarged side elevation view of symmetrical assembling pin 9 with central recess 35, and hooked ends 36, 37, having distal concave notches 38, 39, into which the cross bars of the lateral handles are pivotally received. Similarly, FIG. 14 is an enlarged perspective view of assembling pin 9, central recess 35, hooked ends 36, 37 and distal concave notches 38, 39.

Figure 15:
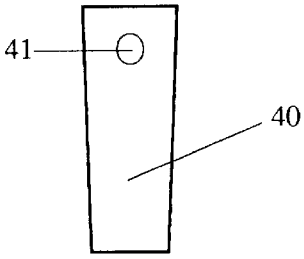
FIG. 15 is a top elevation view of a jaw pincer member according to the present invention.

FIG. 15 is a top elevation view of general jaw pincer member 40, showing substantially circular bore 41. FIG. 15 illustrates that all three of the jaw pincer members 2, 17 and 28 are provided with aligned, substantially circular orifices bored in the vicinity of the open end of the jaw members.

Figure 16:
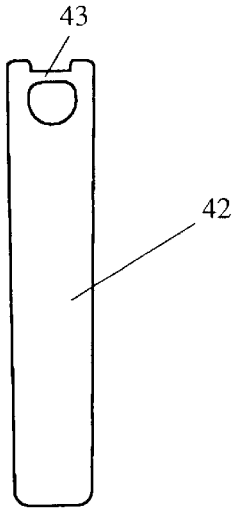
FIG. 16 is a top elevation view of a handle according to the present invention.

FIG. 16 is a top elevation view of general handle 42, showing cross-bar 43 which is pivotally coupled with concave notches 38, 39 of transverse assembling pin 9. FIG. 16 illustrates that these nail clipper handles do not have a toe or protrusion associated with them, as these generally are not required in the nail clipper of the present invention.

Figure 17:
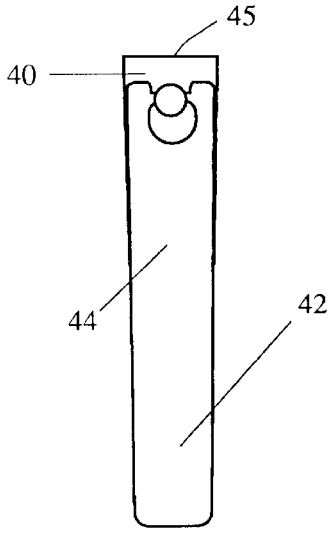
FIG. 17 is a top elevation view of a nail clipper according to the present invention.
Figure 18:
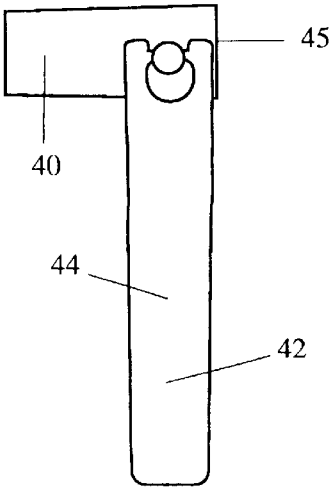
FIG. 18 is a top elevation view of the nail clipper of FIG. 17 where the jaw pincer member is rotated at a right angle with respect to the handles of the nail clipper.
Figure 19:
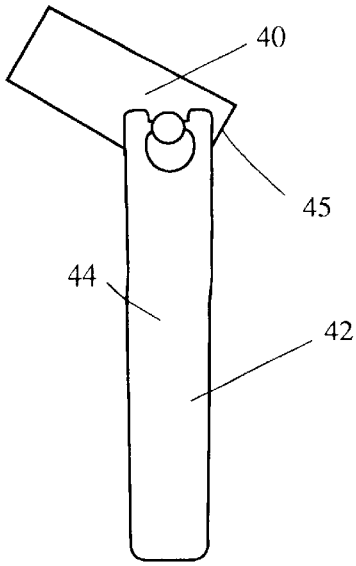
FIG. 19 is a top elevation view of the nail clipper of FIG. 17 where the jaw pincer member is rotated at an oblique angle with respect to the handles of the nail clipper.

FIGS. 17, 18 and 19 are top elevation views of nail clipper 44 showing various angles of rotation between handles 42 and jaw pincer member 40 having cutting edges 45. These Figures illustrate that the handles remain aligned to each other when in their open position, ready for use, irrespective of the angle of rotation between the handles and the pincer jaw member.

FIG. 20 illustrates toe nail clipper 46 which is designed to operate with increased mechanical advantage. Its jaw pincer member 47 has long jaw members 48, 49 connected together by means of hinge 50. Nail clipper 46 is provided with transverse assembling pin 51 and coil spring 52 to keep jaw members 48, 49 biased apart.

FIG. 21 illustrates a typical jaw pincer member 53 of nail clippers of the prior art. FIGS. 20 and 21 are presented side-by-side to facilitate comparison between the effective lengths of the jaw members of jaw pincer members 47 and 53. Although jaw pincer member 47 is shorter than jaw pincer member 53, the effective length of the lever of jaw members 48 and 49 is greater. The preferred value of distance "a" representing the length of the jaw member is approximately 7.5 cm.

FIGS. 22 and 23 illustrate another feature of toe nail clipper 46. FIG. 22 shows a segment of lateral handle 54 having short bifurcated portion 55 and long portion 56. The intersection point 57 of cross line 58 indicate the standard position of cross bar 43 on small bifurcated portion 55. FIG. 23, in turn, shows displaced intersection point 60 of cross bar 43 and cross line 61 on the bifurcated portion 55 of lateral handle 54. Due to the position of the cross bar being displaced, the distance between the fulcrum of lever system and the point designating the application of force via handle 54 is shortened, resulting is considerably increased mechanical advantage.

This feature is again illustrated in FIGS. 24 and 25. In FIG. 25, cross bar 43 has been displaced toward the long portion 64 of handle (lever) 42. Cross bar 43 is the fulcrum of handle 42, while line of curvature 63 substantially coincides with the point of application of force on handle 42. Thus, the fulcrum and the point of application of force of handle 42 are closer in FIG. 25 than in FIG. 24. Consequently, mechanical advantage is substantially increased. It should be noted that in FIG. 25, cavity 66 extends into the long portion 64 of lever 42, and that the distance "b" between cross bar 43 and line of curvature 63 is approximately 3 mm.

FIG. 26A shows a transverse assembling pin 9 of normal length, and a shorter transverse assembling pin 67 which is used in toe nail clipper 46. In FIG. 26B, shorter transverse assembling pin 67 proportionally decreases the length of separation between the cutting edges of pincer jaw member 47 while at the open position, ready for use. In turn, this decreases the length of the portion of the cutting stroke where the cutting edges are not in contact with the nail to be clipped. Again, the desired result is to increase the cutting force of the cutting edges or blades, by means of increased mechanical advantage of the lever system of toe nail clipper 46. A reduction in assembling pin length of up to 20%, with a corresponding reduction in the distance between the cutting edges or blades, does not interfere with the comfortable positioning of the nail to be clipped or trimmed, between the blades.

FIG. 27 shows jaw members 48, 49, at their ready condition at the beginning of a cutting stroke. The preferred distance "c" between cutting edges 5, 6 is approximately 2.4 mm.

Figure 28:
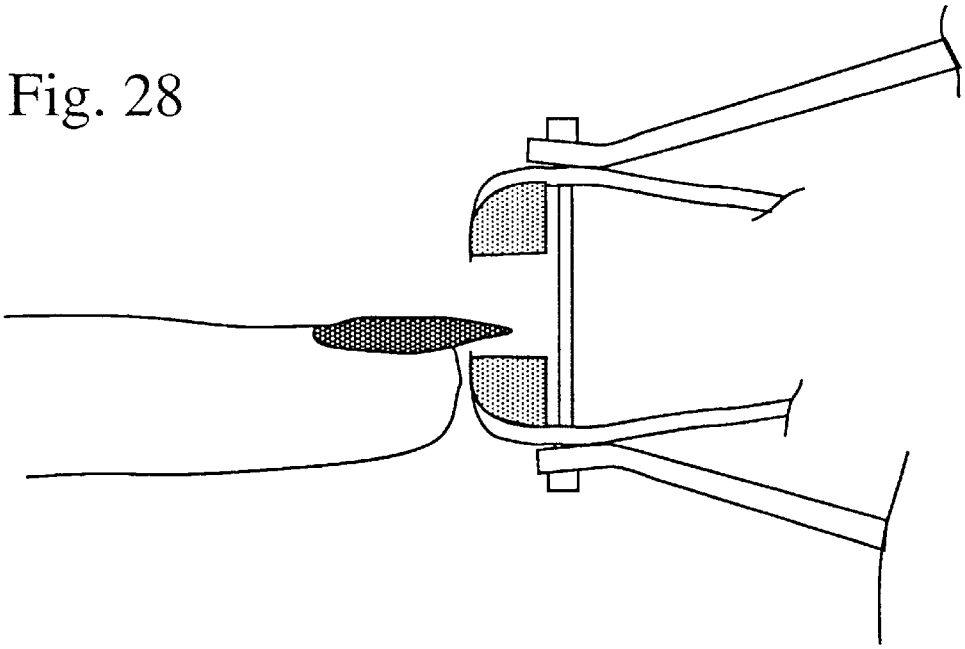
FIG. 28 is a longitudinal side elevation view of yet another embodiment of the present invention at the beginning of a cutting stroke.

FIG. 28 shows nail clipper 68 at its open position, ready for use. Jaw pincer member 69 includes first jaw member 70 and second jaw member 71 having inner curved spaces 72, 73 adjacent to cutting edges or blades 5, 6. Inner curved spaces 72, 73 are provided with molded and glued cushions or tongs 74, 75, made of an elastic material (e.g., a plastic material), such as "EVA" or rubber, or any other resilient and preferably somewhat compressible material. Nail tip 76 of finger 77 is positioned between cutting edges or blades 5, 6, and abutted against blade 5, to perform a nail clipping operation.

Figure 29:
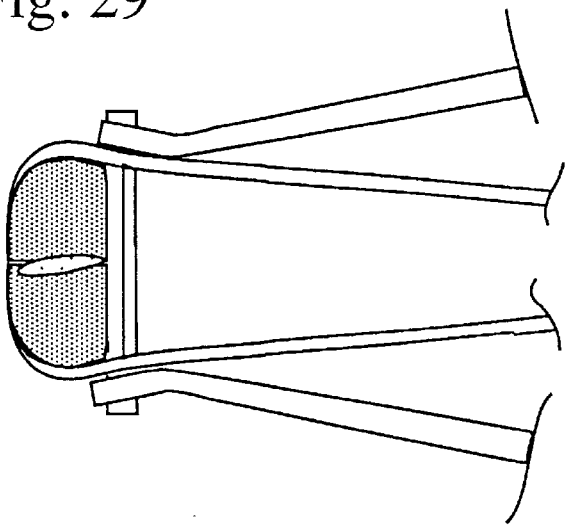
FIG. 29 is a longitudinal side elevation view of the nail clipper of FIG. 28 at the end of a cutting stroke.

FIG. 29 shows nail clipper 68 immediately after the end of a cutting stroke, when cutting edges are in contact and are pressed against one another, and cut nail fragment 78 is entrapped between tongs 74, 75, and remains there, as long as lateral handles 12, 13 are pressed toward each other.

Figure 30:
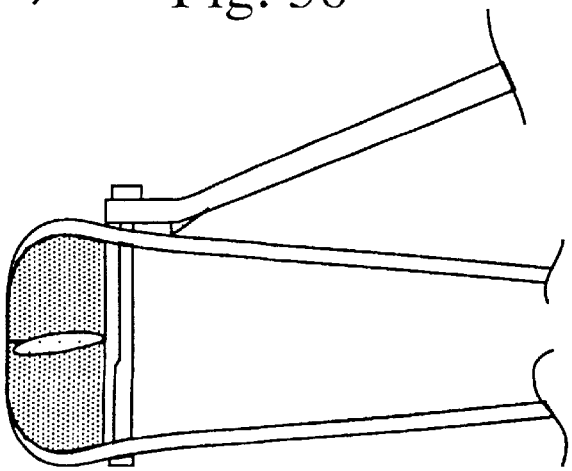
FIG. 30 is a longitudinal side elevation view of a nail clipper of the prior art at the end of a cutting stroke.

FIG. 30 illustrates prior art nail clipper 79 with coupled lever 80, having a toe 81 and asymmetric assembling pin 82. Inner curved spaces 83, 84 of prior art jaw pincer member 53 are provided with tongs 72, 73, which are capable of retaining cut nail fragment 78 therebetween, as long as both handles of nail clipper 79 are pressed toward each other, immediately after completion of a cutting stroke.

Figure 31:
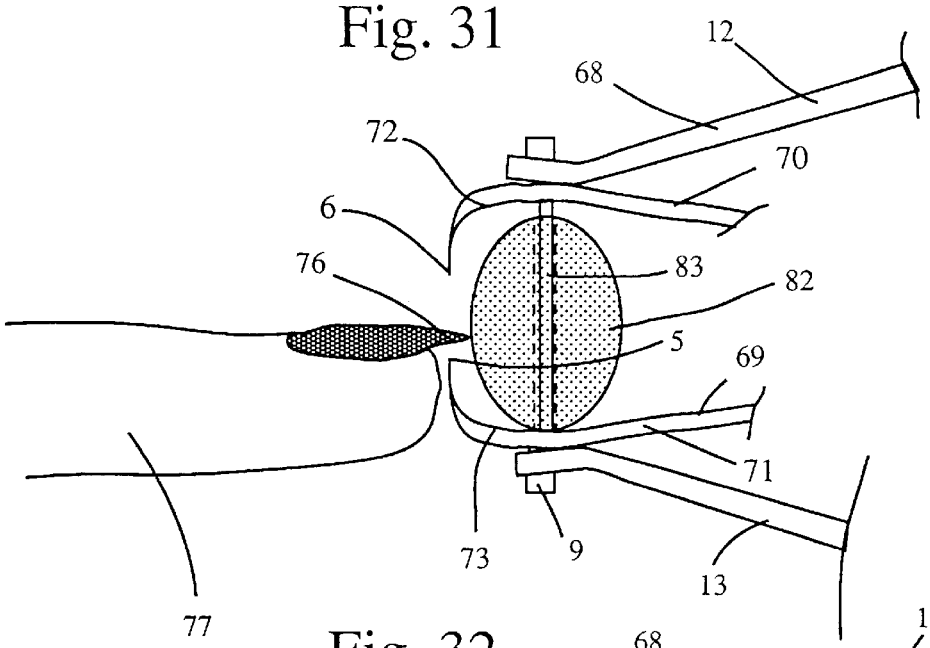
FIG. 31 is a longitudinal side elevation view of yet another embodiment of the present invention at the beginning of a cutting stroke.

FIG. 31 shows nail clipper 68 at its open position, ready for use. It is provided with plastic foam piece 82 which is substantially ellipsoidal and has truncated flat poles. Piece 82 has a cylindrical central bore 83 through which transverse assembling pin 9 is inserted between jaw members 70, 71. Here again, the tip of nail 76 is inserted between cutting edges 5, 6, and abutted on cutting edge 5, in order to continue with the cutting stroke.

Figure 32:
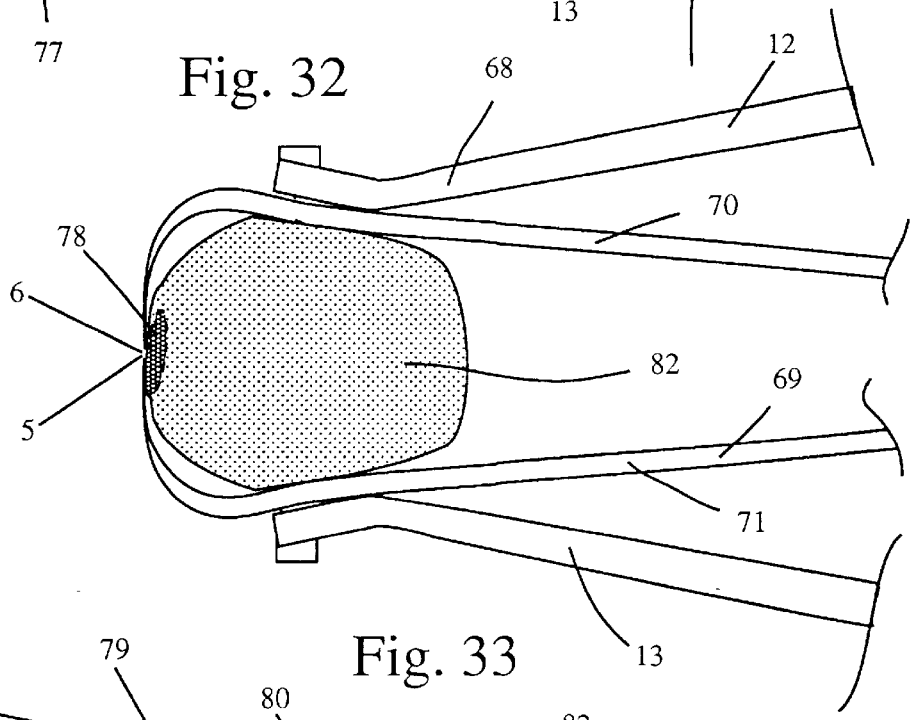
FIG. 32 is a longitudinal side elevation view of the nail clipper of FIG. 31 at the end of a cutting stroke.

FIG. 32 illustrates nail clipper 68 at the end of a cutting stroke. Piece 82 has deformed and expanded in response to the pressure of jaw members 71, 72. In so doing, it has blocked and entrapped nail fragment 78, by the inner space of cutting edges 5, 6.

Figure 33:
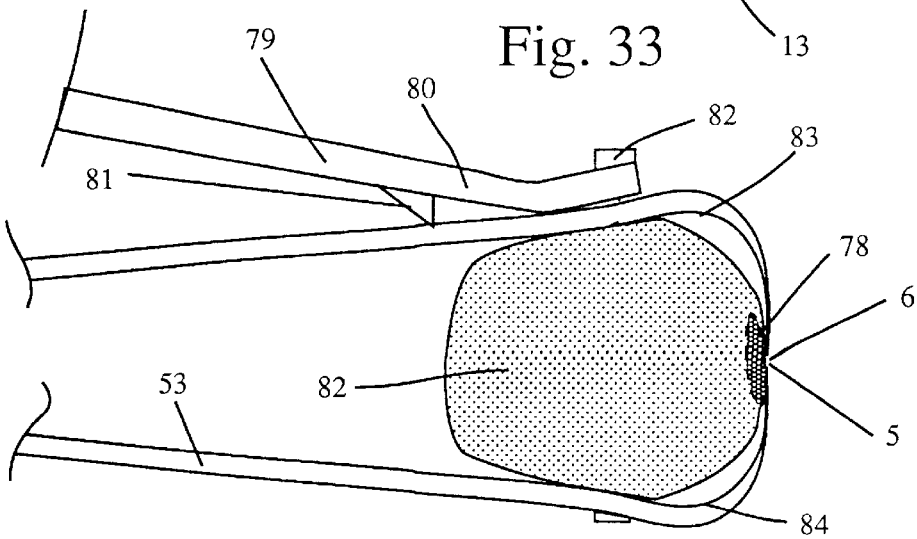
FIG. 33 is a longitudinal side elevation view of a nail clipper of the prior art at the end of a cutting stroke.

FIG. 33 illustrates prior art nail clipper 79 with coupled lateral lever 80, having a toe 81 and asymmetric assembling pin 82. Inner curved spaces 83, 84, of prior art jaw pincer member 53 is provided with plastic foam piece 82, shown in its deformed and expanded condition, thus entrapping nail fragment 78 as long as both handles of the nail clipper 79 are pressed into one another, immediately after the completion of a cutting stroke.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed is:

1. A nail clipper comprising:

two elongated jaw members having opposed, spaced apart cutting blades at a first end;

the two jaw members being connected at a second end to form a substantially Y-shaped, resilient central pincer member;

the two jaw members having aligned openings;

a transverse assembling pin with hooked first and second ends, said transverse assembling pin having an axis, said transverse assembling pin being rotatable about said axis;

two symmetrical elongated handles, each of the elongated handles including a short portion and a long portion;

each of the short portions having a U-shaped bifurcated end and a handle cross bar connecting the bifurcated end, said handle cross bar having an axis; and each hooked end of the transverse assembling pin being hingedly connected to a respective one of said handle cross bars so that each handle is rotatable about the axis of said cross bar to retain the elongated handles in alignment with each other, each jaw member being rotatable about the axis of said transverse assembling pin, whereby each handle can be positioned and actuated at any angle with respect to said jaw members to clip a nail, and can also be rotated from said cutting position to a storage position by rotation about the axis of said cross bar and the axis of said transverse assembling pin.

2. The nail clipper according to claim 1, wherein the long portions of the two symmetrical handles are substantially straight.

3. The nail clipper according to claim 1, wherein the long portions of the two symmetrical handles are curved.

4. The nail clipper according to claim 1, wherein a rivet connects the two jaw members at the second ends.

5. The nail clipper according to claim 1, further comprising:

a tong of an elastic material being provided on an inner portion of the first end of each jaw member, the tong being capable of blocking and retaining a nail fragment at the end of a cutting stroke.

6. The nail clipper according to claim 5, wherein the elastic material of the tong is comprised of plastic foam.

7. The nail clipper according to claim 5, wherein the elastic material of the tong is comprised of rubber.

8. The nail clipper according to claim 1, further comprising:

a substantially ellipsoidal piece of an elastic material having two flat pole ends and a cylindrical axial bore;

the ellipsoidal piece receiving the transverse assembling pin, and the flat pole ends being in contact with the jaw members; and the ellipsoidal piece being capable of blocking and retaining a nail fragment at the end of a cutting stroke.

9. The nail clipper according to claim 8, wherein the elastic material of the ellipsoidal piece is comprised of plastic foam.

10. A nail clipper comprising:

two elongated jaw members having opposed cutting blades at a first end, the two jaw members being hingedly connected at a second end to form a substantially U-shaped, resilient central pincer member;

the two jaw members having substantially round, aligned openings;

a transverse assembling pin with hooked first and second ends, said transverse assembling pin having an axis, said transverse assembling pin being rotatable about said axis;

a coil spring receiving the transverse assembling pin and biasing apart the first ends of the two elongated jaw members;

two symmetrical elongated handles, each of the elongated handles including a short portion and a long portion;

each of the short portions having a U-shaped bifurcated end and a handle cross bar connecting the bifurcated end, said handle cross bar having an axis; and each hooked end of the transverse assembling pin being hingedly connected to a respective one of said handle cross bars so that each handle is rotatable about the axis of said cross bar to retain the elongated handles in alignment with each other, each jaw member being rotatable about the axis of said transverse assembling pin, whereby each handle can be positioned and actuated at any angle with respect to said jaw members to clip a nail, and can also be rotated from said cutting position to a storage position by rotation about the axis of said cross bar and the axis of said transverse assembling pin.

11. The nail clipper according to claim 10, wherein:

the length between the respective first ends and second ends of the jaw members is at least approximately 7.5 cm; and the distance between the cutting blades is approximately 2.4 mm when the nail clipper is in an open position.

12. The nail clipper according to claim 10, wherein the long portions of the two symmetrical handles are substantially straight.

13. The nail clipper according to claim 10, wherein the long portions of the two symmetrical handles are curved.

14. A nail clipper comprising:

two elongated jaw members having opposed, spaced apart cutting blades at a first end, the two jaw members being connected at a second end to form a substantially U-shaped, resilient central pincer member;

the two jaw members having substantially round, aligned openings;

a transverse assembling pin with hooked first and second ends, said transverse assembling pin having an axis, said transverse assembling pin being rotatable about said axis;

two symmetrical elongated handles, each of the elongated handles including a short portion and a long portion;

each of the short portions having a U-shaped bifurcated end and a handle cross bar connecting the bifurcated end, said handle cross bar having an axis; and each hooked end of the transverse assembling pin being hingedly connected to a respective one of said handle cross bars so that each handle is rotatable about the axis of said cross bar to retain the elongated handles in alignment with each other, each jaw member being rotatable about the axis of said transverse assembling pin, whereby each handle can be positioned and actuated at any angle with respect to said jaw members to clip a nail, and can also be rotated from said cutting position to a storage position by rotation about the axis of said cross bar and the axis of said transverse assembling pin.

15. The nail clipper according to claim 14, wherein the long portions of the two symmetrical handles are substantially straight.

16. The nail clipper according to claim 14, wherein the long portions of the two symmetrical handles are curved.

17. The nail clipper according to claim 14, further comprising:

a tong of an elastic material being provided on an inner portion of the first end of each jaw member, the tong being capable of blocking and retaining a nail fragment at the end of a cutting stroke.

18. The nail clipper according to claim 17, wherein the elastic material of the tong is comprised of plastic foam.

19. The nail clipper according to claim 17, wherein the elastic material of the tong is comprised of rubber.

20. The nail clipper according to claim 14, further comprising:

a substantially ellipsoidal piece of an elastic material having two flat pole ends and a cylindrical axial bore;

the ellipsoidal piece receiving the transverse assembling pin, and the flat pole ends being in contact with the jaw members; and the ellipsoidal piece being capable of blocking and retaining a nail fragment at the end of a cutting stroke.

21. The nail clipper according to claim 20, wherein the elastic material of the ellipsoidal piece is comprised of plastic foam.

* * * * *